US006394400B1

(12) United States Patent
Sontag

(10) Patent No.: US 6,394,400 B1
(45) Date of Patent: May 28, 2002

(54) FRAMES FOR PLASTIC BAGS

(76) Inventor: Ronald E. Sontag, 5011 Graves Rd., Alvin, TX (US) 77511

( * ) Notice: Subject to any disclaimer, the term of this patent is extended or adjusted under 35 U.S.C. 154(b) by 0 days.

(21) Appl. No.: 09/641,397

(22) Filed: Aug. 17, 2000

Related U.S. Application Data

(60) Provisional application No. 60/149,211, filed on Aug. 17, 1999.

(51) Int. Cl.[7] ..... A63B 55/04
(52) U.S. Cl. ..... 248/97
(58) Field of Search ..... 248/95, 97, 99, 248/101

(56) References Cited

U.S. PATENT DOCUMENTS

| | | | | |
|---|---|---|---|---|
| 968,349 | A | | 8/1910 | Hanson |
| 1,005,956 | A | | 1/1911 | Gibbins |
| 1,858,793 | A | | 5/1932 | Reynolds |
| 4,281,813 | A | | 8/1981 | Garrity |
| 4,366,916 | A | | 1/1983 | Guido et al. |
| 4,457,483 | A | | 7/1984 | Gagne |
| 5,129,609 | A | | 7/1992 | Tobin |
| 5,263,672 | A | * | 11/1993 | He ..... 248/97 |
| 5,772,046 | A | * | 6/1998 | Tercher et al. ..... 248/95 |
| 6,267,334 | B1 | * | 7/2001 | Siu ..... 248/97 |

FOREIGN PATENT DOCUMENTS

CA 986896 4/1976

* cited by examiner

*Primary Examiner*—Ramon O. Ramirez
(74) *Attorney, Agent, or Firm*—Richard C. Litman

(57) ABSTRACT

A versatile frame to facilitate the holding open of a plastic bag. The invention facilitates a single individual in emptying food and liquids into a plastic or other flexible bag without spilling its contents. The device takes the shape of a topless barrel truncated along a vertical plane through each of two opposite sides of the barrel. The bottom is horizontally extendable and the walls are vertically extendable, each having multiple locking positions. The device can be disassembled and stored in a substantially L-shaped arrangement for economy of space. The present invention can accommodate bags having various volumes. The device also features a stand, including a plurality of rubber feet to improve traction, as well as upper rims capped with a rubbery material to facilitate the grip on the opening circumference of a plastic bag. Other embodiments include a bookcase shaped device with adjustable height sides.

14 Claims, 7 Drawing Sheets

FRAMES FOR PLASTIC BAGS

CROSS-REFERENCE TO RELATED APPLICATION

This application claims the benefit of U.S. Provisional Patent Application Ser. No. 60/149,211, filed Aug. 17, 1999.

BACKGROUND OF THE INVENTION

1. Field of the Invention

The present invention relates generally to small plastic bag holders. More specifically, the invention comprises at least three frames for holding small plastic bags open for filling with food for freezing.

2. Description of Related Art

The relevant art of interest describes various bag holders, but none discloses the present invention. There is a need for economical small plastic bag holders configured either as a slotted or closable gate-type basket or an adjustable size bookend-type holder. The relevant art of interest will be discussed in the order of perceived relevance to the present invention.

U.S. Pat. No. 968,349 issued to Louis Hanson on Aug. 23, 1910, describes a metal telescoping bag or sack holder comprising two adjacent half-cylindrical walls wherein the inside wall is held fixedly while the rear wall slides up from a supporting back with two bowed springs. A contractile metal band is placed over the overlapping sack to hold the sack in place. A bail and handle is attached to the outside movable wall. Hanson is distinguishable for its half-cylindrical structure with a rear pull-up wall and required split ring.

U.S. Pat. No. 1,005,956 issued to Frank Gibbins on Oct. 17, 1911, describes a hemispherical multi-standard coal or grain bag holder comprising two hemispherical hoops braced by four standards with latches on the outermost standards for holding the bags open by their handles. The bag holder is distinguishable for its open frame structure and requirement for bag holding latches.

U.S. Pat. No. 5,129,609 issued to Brian E. Tobin on Jul. 14, 1992, describes a flexible trash bag support apparatus for insertion inside a plastic bag for filling grass and trash comprising an open but foldable cardboard support having four sides, wherein the rear side extends above the adjacent sides having hand slots on top and two outer sides. One embodiment includes an apertured top cover. The bag support apparatus is distinguishable for insertion within a plastic bag.

U.S. Pat. No. 4,457,483 issued to Laureat Gagne on Jul. 3, 1984, describes a collapsible flexible support for garbage bags made from a rectangular sheet of plasticized cardboard, fiberboard or linoleum having embossed tabs on the longer upper and lower edges for holding the folded over plastic bags. The shorter sides have knobs on one side for engagement with openings on the opposite side for forming the cylindrical support. The support device is distinguishable for its collapsible flexible structure.

U.S. Pat. No. 1,858,793 issued to Archibald Reynolds on May 17, 1932, describes a two-size bag holder for a grocery store comprising a U-shaped cylindrical vertical member on a base and having a swingable shelf with a latch to accommodate the smaller bag. A separate funnel is added and supported by a semicircular brace on top. The bag holder is distinguishable for its two-tiered structure.

U.S. Pat. No. 4,281,813 issued to John J. Garrity on Aug. 4, 1981, describes a wire mesh foldable bag holder having eight hinged members to form an octagonal cylinder with open ends. The top of the bag is folded over the top edge. The bag holder can be disconnected on one edge. The bag holder is distinguishable for its foldable meshed structure and open ends.

U.S. Pat. No. 4,366,916 issued to Joseph J. Guido et al. on Jan. 4, 1983, describes a convertible bag packing container and bag support device comprising a rectangular box having a front side with a U-shaped cut which is covered by a separate front panel having a top fold over flap. The two sides have perforated side ears. Collapsed bags are stored in the container. The container is distinguishable for its folding structure and removable front wall.

Canadian Patent No. 986,896 issued to Selmer L. Jerpbak on Apr. 6, 1976 describes a distender device and method for filling flexible trash bags comprising a cylindrical plastic tube made from a rectangular sheet formed helically and having attachable fasteners to support the bag inside its frame. The distender device is distinguishable for its cylindrical helical structure.

None of the above inventions and patents, taken either singly or in combination, is seen to describe the instant invention as claimed.

SUMMARY OF THE INVENTION

The present invention is a versatile frame to facilitate the holding open and filling of a plastic bag. The invention facilitates a single individual in emptying food and liquids into a plastic or other flexible bag without spilling its contents. The preferred first embodiment comprises a substantially L-shaped base member which receives like a belt buckle a substantially L-shaped base-supported member. Each member consists essentially of a flat, interlocking horizontal segment integrated with an arcuate, vertical wall. Each vertical wall has a removable, arcuate, vertically telescoping extension. When the two horizontal segments interlock so as to the in a ready-to-use position, the device takes the shape of a topless barrel slotted or truncated along a vertical plane through each of two opposite sides of the barrel. The bottom is horizontally extendable and the walls are vertically extendable, each having multiple locking positions. The device can be disassembled and stored in a substantially L-shaped arrangement for economy of space. The present invention can accommodate bags having various volumes. The device also features a stand, including a plurality of rubber feet to improve traction, as well as upper rims capped with a rubbery material to facilitate the grip on the opening circumference of plastic bag. A second embodiment features a bookrack structure with adjustable height ends. A third embodiment comprises a bookrack structure with adjustable sides of different heights placed in specific slots to accommodate different sized bags.

Accordingly, it is a principal object of the invention to provide an improved bag holder adapted to enable a person to fill a plastic bag with food or liquid while minimizing spills.

It is another object of the invention to provide a bag holder minimizing the space required for storage of the device when not in use.

It is a further object of the invention to provide a bag holding device of a first embodiment comprising two mating parts, connected by a rivet, that rotate upon a common axis.

Still another object of the invention is to provide a bag holder of the first embodiment that is both vertically and horizontally extendable.

Yet another object of the invention is to provide a pair of bag holders shaped like a bookrack with adjustable length and height sides as a second and third embodiment.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
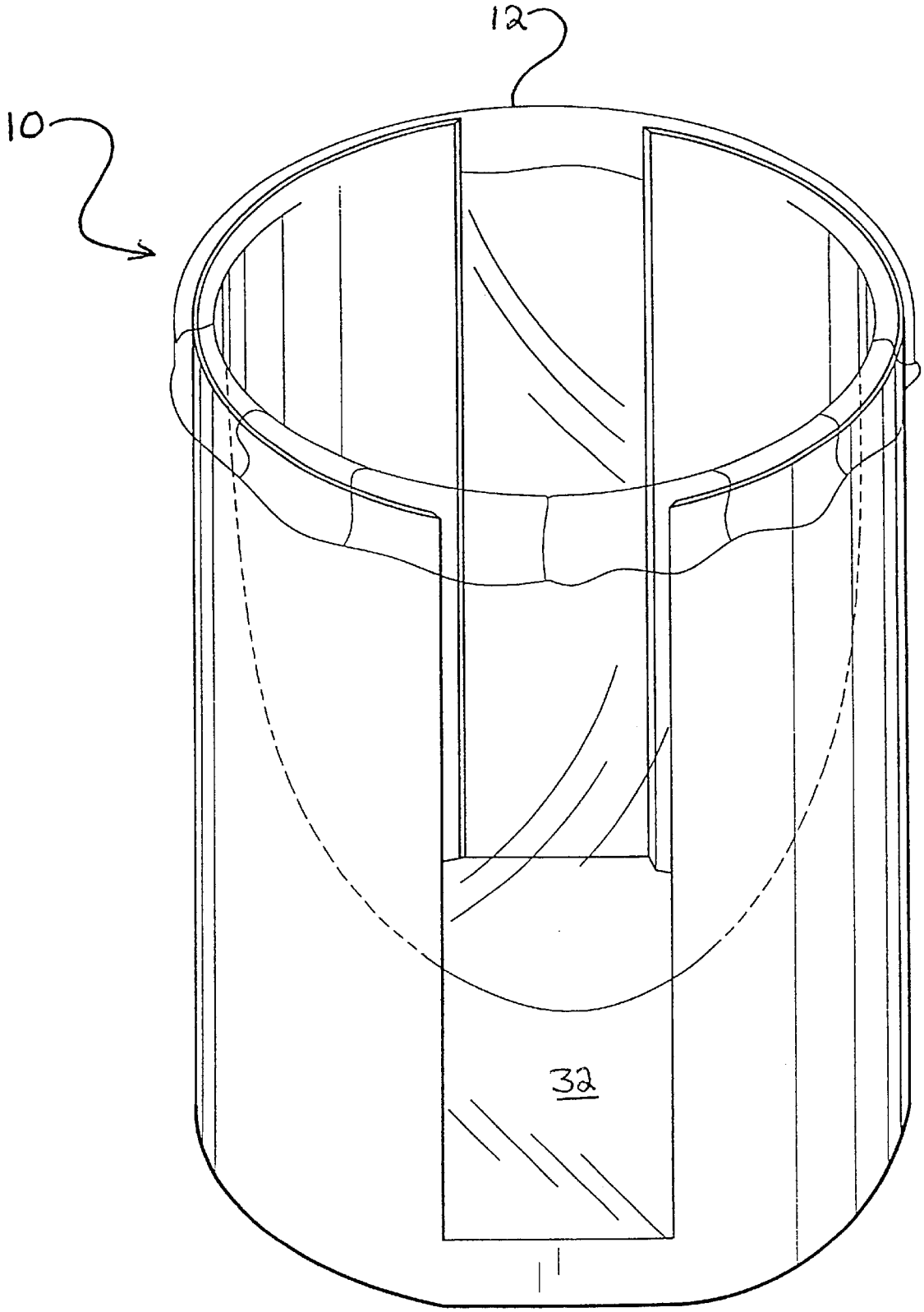
FIG. 1 is an environmental, perspective view of a slotted basket frame for plastic bags according to a first generic embodiment of present invention.
Figure 2:
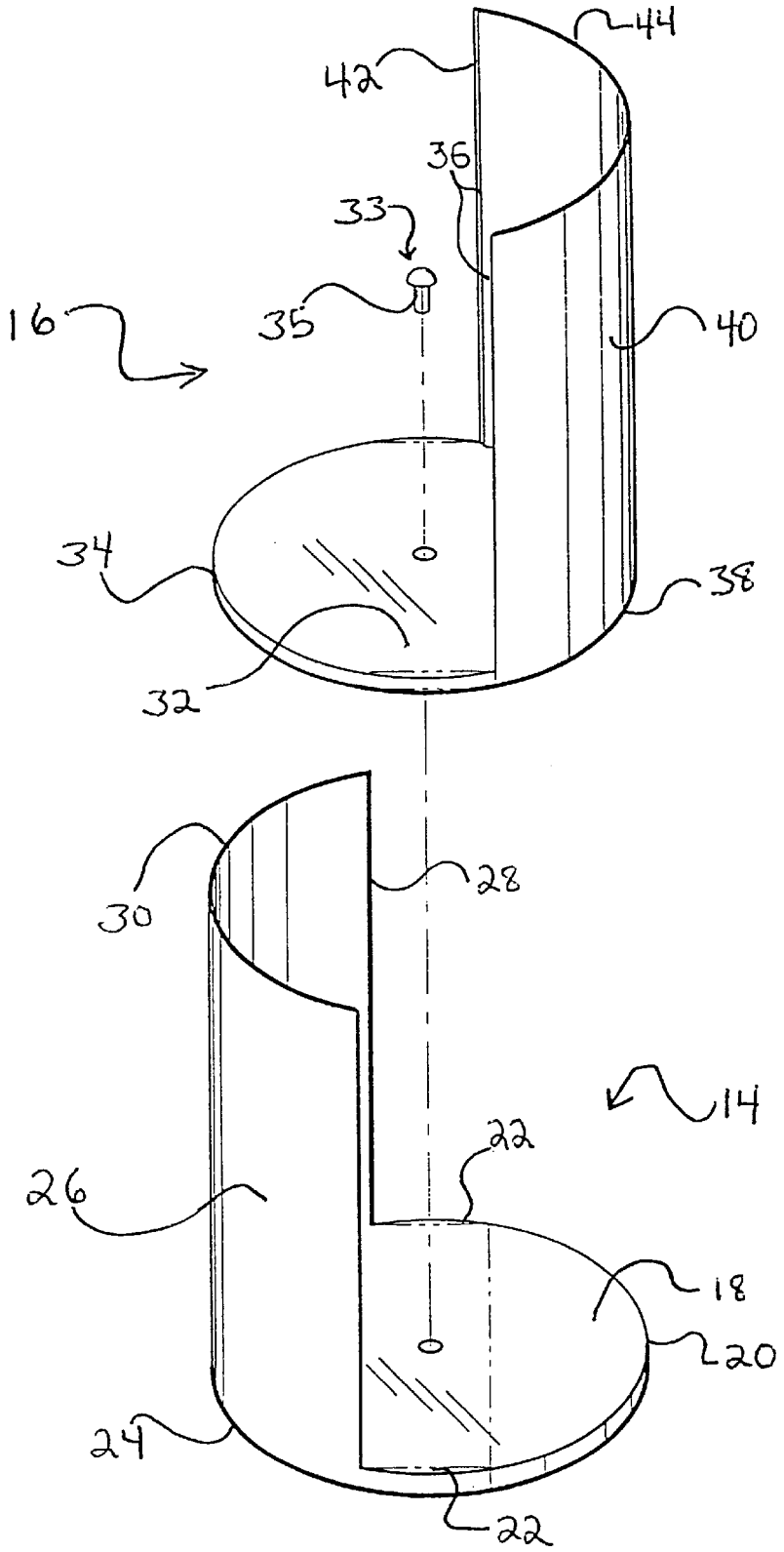
FIG. 2 is an exploded perspective view of an alternate embodiment of rotatable slotted frame for plastic bags.

The first embodiment of the present invention, generically shown in its operating environment in FIG. 1, is a frame 10 for a plastic bag 12. The invention facilitates a single individual in emptying food and liquids into a plastic or other flexible bag without spilling its contents. Referring to FIG. 2, a base-supported member 16 is insertable into a base member 14. Base member 14 includes a planar, horizontal female segment 18 having a front edge 20 and two side edges 22 (shown alternately in FIG. 2 with phantom lines) connecting a back arc 24 from which extends an arcuate vertical first wall 26. First wall 26 has two vertical edges 28 connected by a top edge 30.

A base-supported member 16 comprised of a planar, horizontal male segment 32 having a forward edge 34 and two lateral edges 36 connecting a rear arc 38 from which extends a arcuate vertical second wall 40. Second wall 40 has two upright edges 42 connected by an upper edge 44. Rear arc 38 of base-supported member 16 has a radius that is less than the radius of base member 14 such that base-supported member 16 internally couples with base member 14. A bottom surface of female segment 18 can also have a plurality of curved rubber feet (not shown) for traction.

Figure 3:
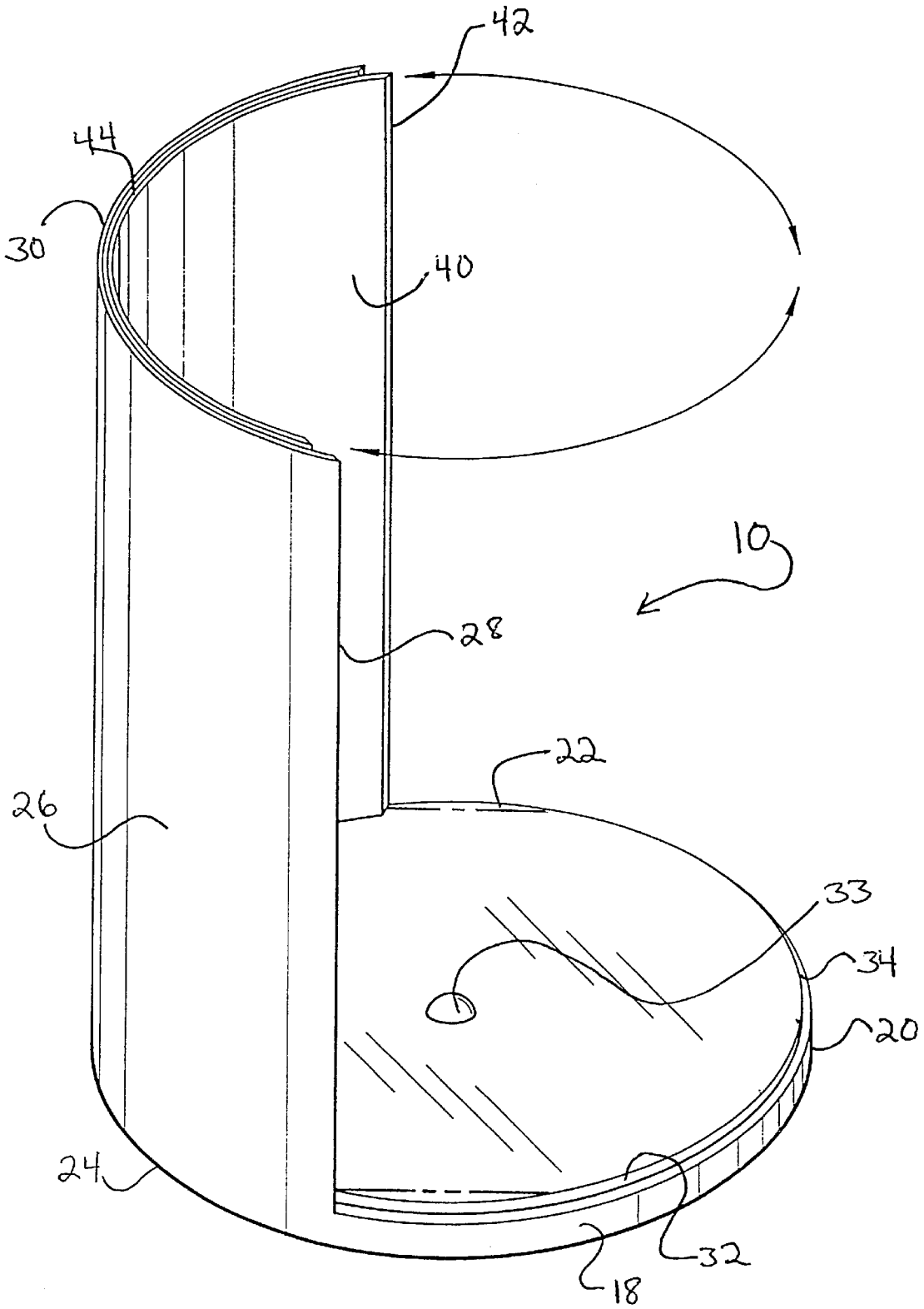
FIG. 3 is an environmental perspective view of the alternate embodiment show in FIG. 2, showing the invention in its compact stored position.
Figure 4:
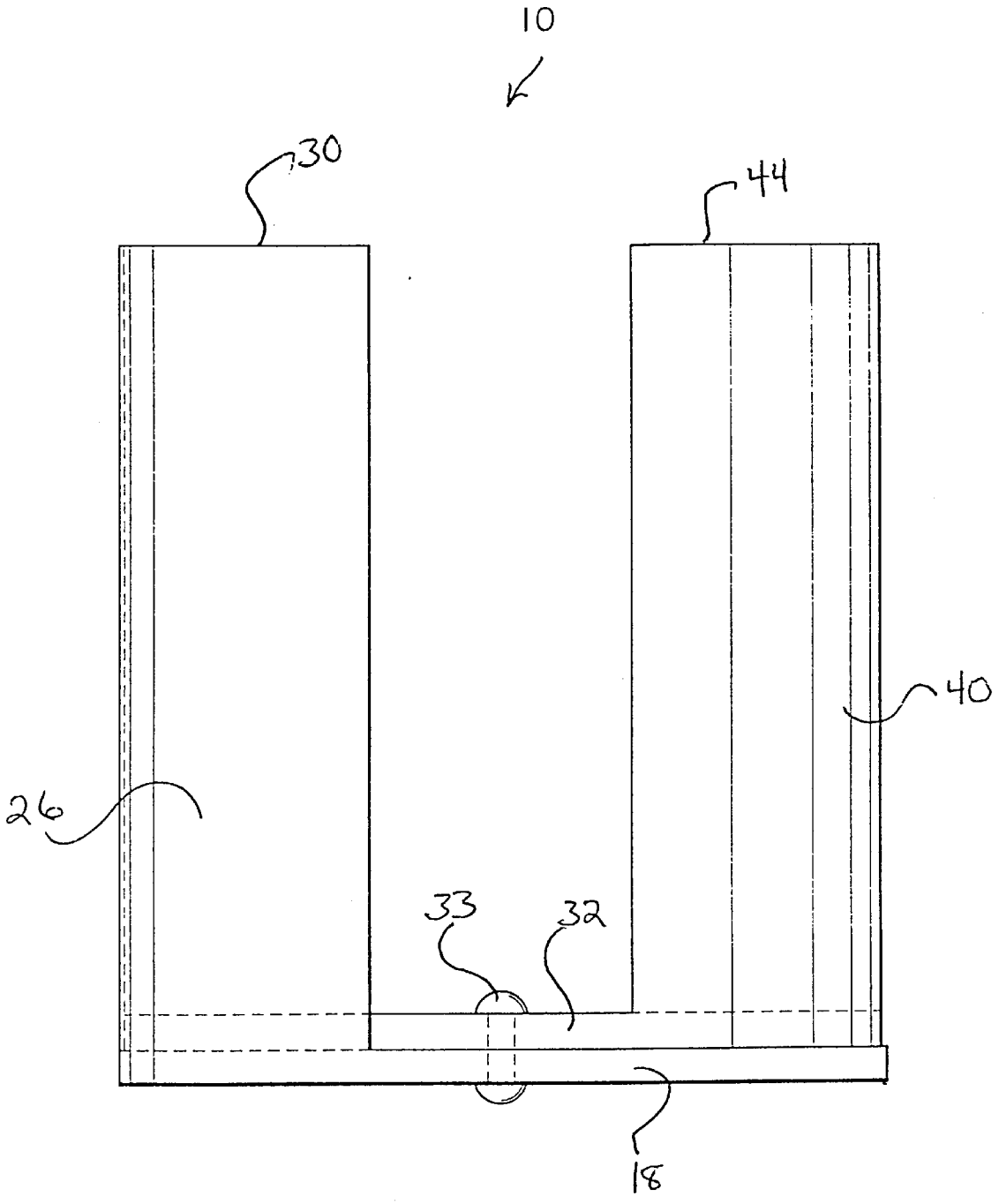
FIG. 4 is an elevational view of the alternate embodiment shown in FIG. 2, showing the invention in its ready-to-frame position.

Regarding the first embodiment, as shown in greater detail in FIGS. 2, 3 and 4, male segment 32 is both above and supported by female segment 18. Rear arc 38 of base-supported member 16 (the upper member) has a radius that is less than the radius of base member 14 by slightly more than the thickness of first wall 26. This enables base-supported member 16, including its vertical second wall 40, to be slidably rotatable with respect to, and inside of, base member 14 and its vertical first wall 26. In fact, second wall 40 can rotate 360° inside of first wall 26. And as shown in FIG. 3, this enables one to save valuable space when storing the device in a drawer or cupboard.

A rivet 33, preferably made from plastic, is used to secure member 16 to member 14 so that they may freely rotate 360 degrees with respect to each other. Rivet 33 has a vertical shank 35 extending through a center point of both male segment 32 and female segment 18. Shank 35 has a length that is slightly greater than the sum of the base thicknesses of male segment 32 and female segment 18. Rivet 33 has both a bottom head and a top head that sandwiches the male and female segments.

Figure 5:
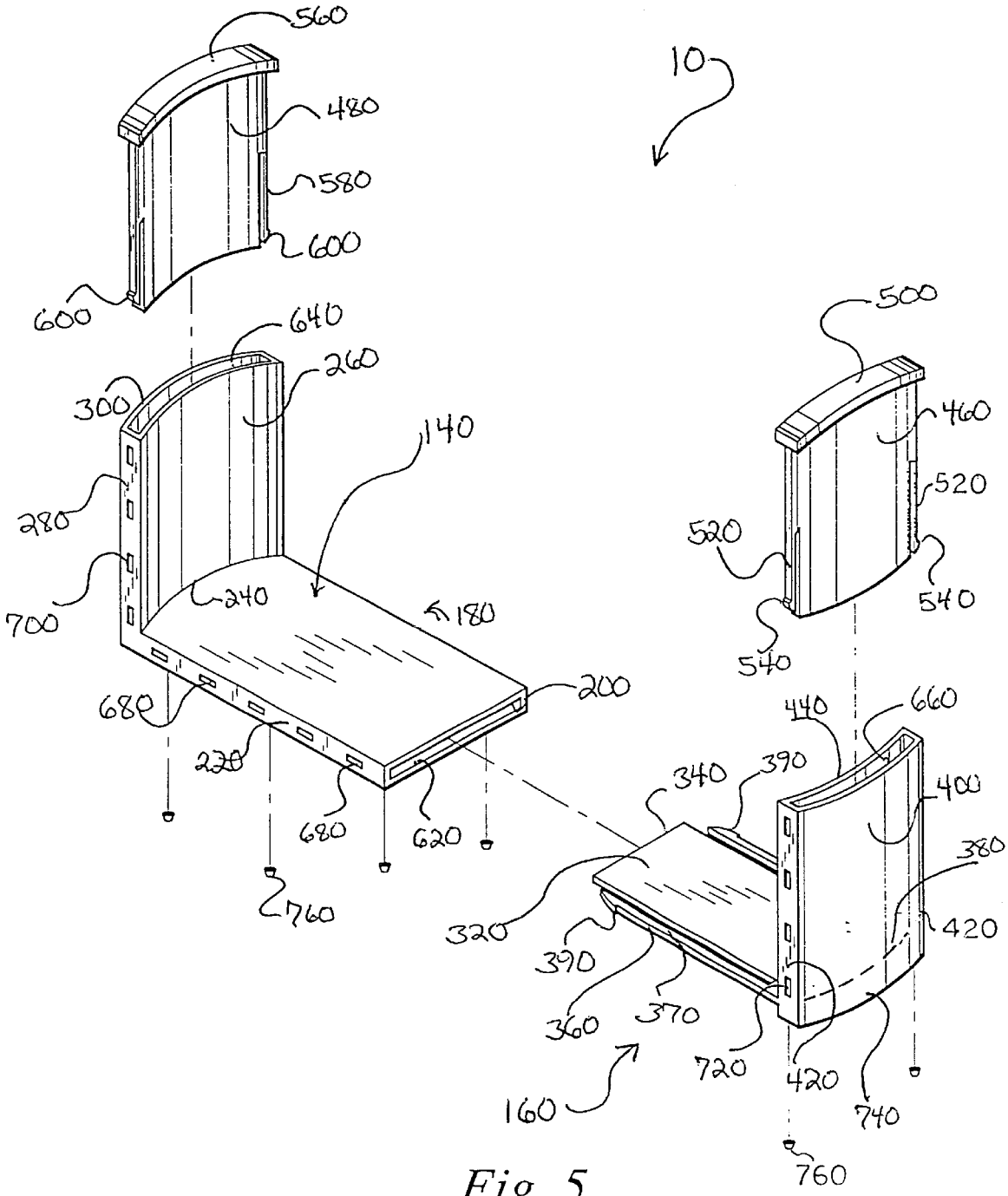
FIG. 5 is exploded perspective view of a second embodiment of a collapsible book shelf frame for plastic bags.
Figure 6:
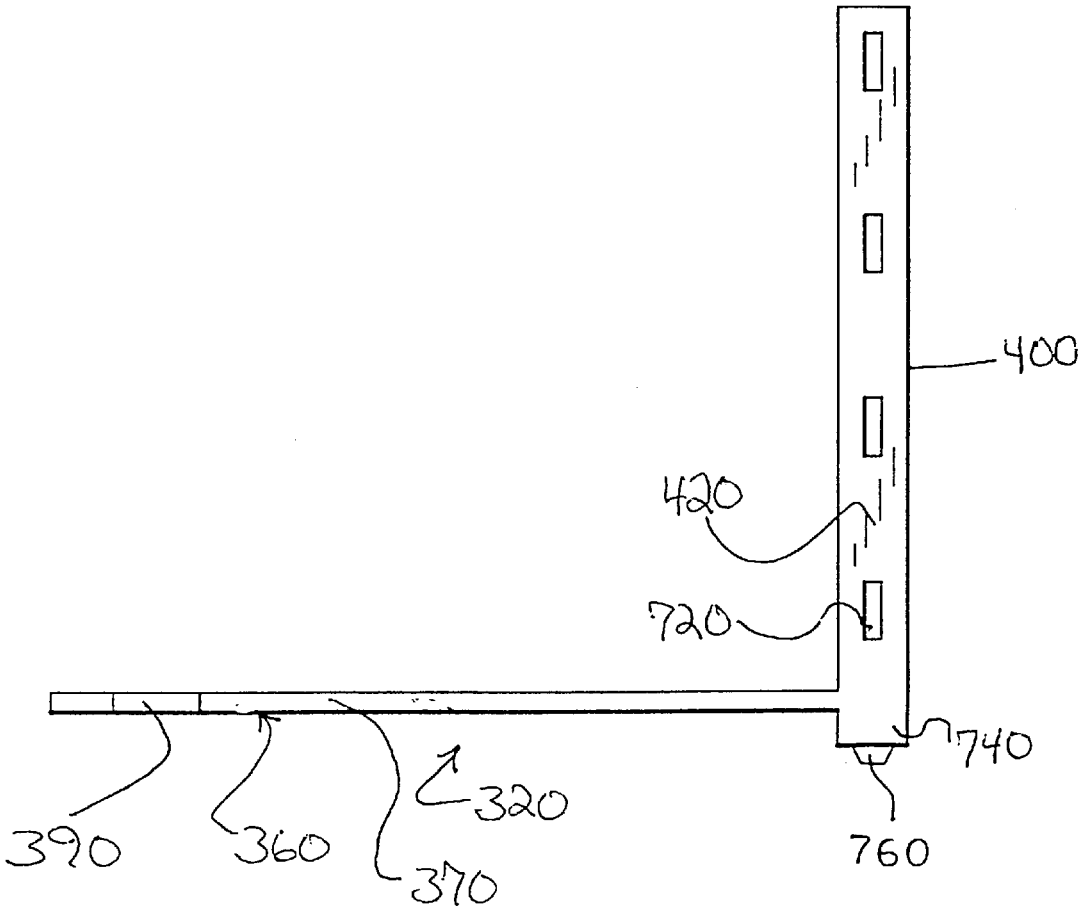
FIG. 6 is an elevational view of the right-hand frame member base of the FIG. 5 embodiment.

Regarding the second embodiment as shown in FIGS. 5 and 6, the device 510 comprises a substantially L-shaped base member 140 which receives like a belt buckle a substantially L-shaped base-supported member 160. Each of members 140 and 160 consists essentially of a flat, interlocking horizontal segment integrated with an arcuate, vertical wall. Each vertical wall has a removable, arcuate, vertically telescoping extension. FIG. 5 illustrates these four essential parts. When the two horizontal segments interlock so as to be in a ready-to-use position, the device takes the shape of a topless barrel slotted or truncated along a vertical plane through each of two opposite sides of the barrel. The bottom is horizontally extendable and the walls are vertically extendable, each having multiple locking positions. The device 510 can be disassembled and stored in a substantially L-shaped arrangement, similar to FIG. 3, and stacked for compact storage.

Base member 140 of female segment 180 has an arcuate, vertical first wall 260 extending from back arc 240 along a perimeter edge of base member 140. An arcuate, vertical first wall extension 480 telescopes in and out of first wall 260. Formed within female segment 180 is a first chamber 620. First chamber 620 extends from front edge 200 to proximate back arc 240. Formed within base member 140 is first chamber 620. A plurality of oppositely disposed apertures, designated as first latch path pairs 680, extend from first chamber 620 to side edges 220 of base member 140.

Male segment 320 of base-supported member 160 has a pair of first arms 370 comprising the lateral edges 360 of male segment. 320. An outwardly disposed cam-type first latch 390 defines a free end of the pair of first arms 370 proximate the forward edge 340 of male segment 320. Male segment 320 is slidably insertable into first chamber 620 of female segment 180 so as to maintain a plurality of locking positions. First latch 390 maintains camming engagement with two opposing inside walls of first chamber 620, and locking engagement with each of said first latch path pairs 680 while the lateral edges 360 abut the inside walls of first chamber 620. Simultaneous finger pressure on the outer edges of first latch 390 unlocks male segment 320 from female segment 180 so as to enable a person to change the locking positions, and thus, to change the distance between first wall 260 and second wall 400 to adapt to the size of the bag.

Formed within first wall 260 and extending from top edge 300 to proximate back arc 240 is a second chamber 640 to receive a vertical, arcuate telescoping first wall extension 480. First wall extension 480 has an upper first rim 560 substantially normal to a pair of vertical second arms 580. An outwardly disposed cam-type second latch 600 defines a free end of the pair of second arms 580. For receiving the extension 480, formed within first wall 260 is a plurality of oppositely disposed second latch path pairs 700. These pairs of pathways extend from second chamber 640 to each of the vertical edges 280 of first wall 260. First wall extension 480 is slidably insertable into first wall 260 so as to maintain a plurality of locking positions. Second latch 600 maintains camming engagement with two opposing inside walls of second chamber 640, and it maintains locking engagement with each of second latch path pairs 700. Similar to the interlocking horizontal segments, simultaneous finger pressure on outer edges of second latch 600 unlocks first wall extension 480 from first wall 260 so as to enable a person to vary the locking positions, and therefore, to vary the height of base member 140.

Formed within second arcuate wall 400, and extending from upper edge 440 to proximate rear arc 380 is a third chamber 660 to receive a vertical, arcuate telescoping second wall extension 460. Second wall extension 460 has an upper second rim 500 substantially normal to a pair of vertical third arms 520. An outwardly disposed cam-type third latch 540 defines a free end of the pair of third arms 520. For receiving the extension 460, formed within second wall 400 is a plurality of oppositely disposed third latch path pairs 720. These pairs of pathways extend from third chamber 660 to each of the upright edges 420 of second wall 400. Second wall extension 460 is slidably insertable into second wall 400 so as to maintain a plurality of locking positions. Third latch 540 maintains camming engagement with two opposing inside walls of third chamber 660, and it maintains locking engagement with each of third latch path pairs 720. Again, simultaneous finger pressure on outer edges of third latch 540 unlocks second wall extension 460 from second wall 400 so as to enable a person to alternate the locking positions, and therefore, to alternate the height of base-supported member 160. Thus, the present invention can accommodate bags having various volumes.

A second embodiment is drawn to a horizontally and vertically extendable book shelf bag support 510, shown in FIGS. 5 and 6. Second wall 400 extends below the horizontal plane of male segment 320 by a distance equal to approximately one half of the thickness of female segment 180 so as to form a leg 740 for member 16 such that male segment 320 maintains horizontal alignment with first chamber 620 of female segment 180. A bottom surface of female segment 180 can have a plurality of rubber feet 760 to improve traction. Another gripping feature can be found in first rim 560 and second rim 500 (FIG. 5) which are capped with a rubbery material to facilitate the grip on the opening circumference of plastic bag 12.

Figure 7A:
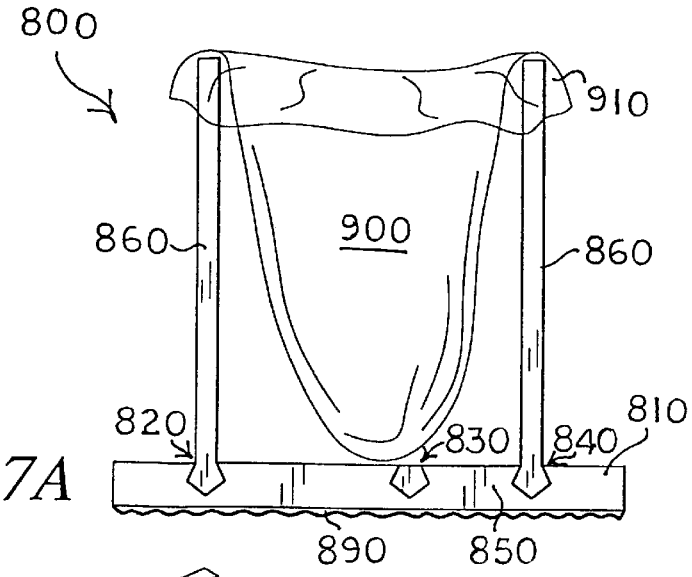
FIGS. 7A, 7B and 7C are draw to a third embodiment of a book shelf bag holder with adjustable length and height sides.
Figure 7B:
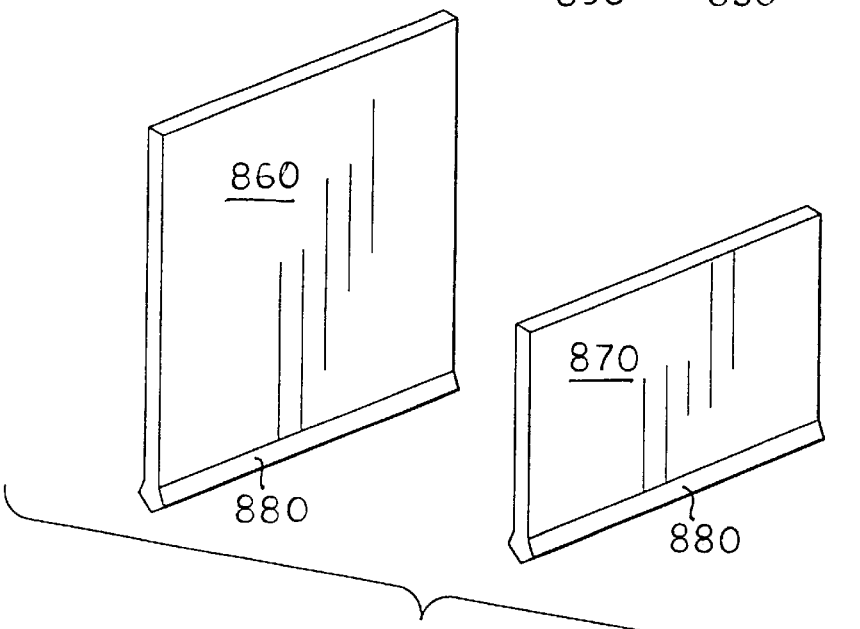
Figure 7C:
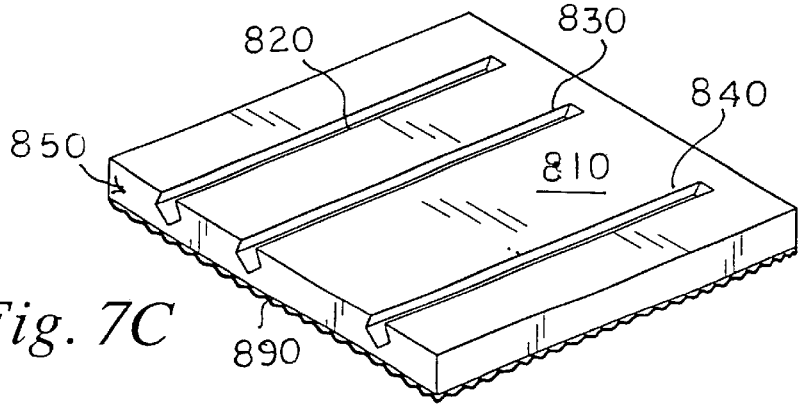

FIGS. 7A, 7B and 7C illustrate a third embodiment drawn to another book shelf bag holder frame 800. A rectangular base plate 810 has three blind grooves 820, 830 and 840 of equal length formed from a front edge 850, but not extending the entire width of the base plate 810. It can be appreciated that the distance between groove 820 and 830 is shorter than the distance between 830 and 840 to accommodate different sized bags. Walls 860 shown in FIG. 7A are taller than the single wall 870 depicted in FIG. 7B to show the relative height difference.

A critical feature of this embodiment is the configuration of the bottom partial pentagonal portions 880 of each wall 860 and 870, to fit snugly in the pentagonal shaped grooves 820, 830 and 840 which are commensurate in length with the widths of the walls 860 or 870. A corrugated rubber layer 890 is positioned under the base plate 810 for preventing slippage on a smooth counter surface.

Thus, a taller and wider plastic bag 900 can be readily accommodated by locating the taller walls 860 in the outside grooves 820 and 840 as depicted in FIG. 7A with the lip 910 disposed over the walls 860. A smaller bag can be framed with the shorter walls 870 shown in FIG. 7B. Then, the frame 800 can readily be dismantled and stored as a flattened package when not in use.

It is to be understood that the present invention is not limited to the embodiments described above, but encompasses any and all embodiments within the scope of the following claims.

I claim:

1. A holder for flexible bags, comprising:

a base member, comprising:

a planar, horizontal female segment having a front edge and two side edges connecting a back arc from which extends a arcuate vertical first wall, said first wall having two vertical edges connected by a top edge;

a base-supported member, comprising:

a planar, horizontal male segment having a forward edge and two lateral edges connecting a rear arc from which extends a arcuate vertical second wall, said second wall having two upright edges connected by an upper edge; and wherein said arc of said base-supported member has a radius that is less than the radius of said base member such that said base-supported member internally couples with said base member.

2. The device according to claim 1, further comprising a plurality of hard, rubber feet disposed on a bottom surface of said female segment.

3. The device according to claim 1, wherein said male segment is entirely above said female segment.

4. The device according to claim 1, wherein said arc of said base-supported member has a radius that is less than the radius of said base member by slightly more than the thickness of said first wall, such that said base member is slidably rotatable with respect to said base-supported member.

5. The device according to claim 1, further comprising a rivet having a vertical shank extending through a center point of each of said male segment and said female segment, said shank having a length that is slightly greater than the sum of the thicknesses of said male segment and said female segment, and said rivet having a bottom head and a top head that sandwiches said male segment and said female segment, such that said base member and said base-supported member are slidably rotatable 360 degrees about said center point and relative to each other.

6. The device according to claim 1, wherein each said edge of said male segment and said female segment is arcuate.

7. The device according to claim 1, further comprising:

a first chamber formed within said female segment and extending from said front edge to proximate said back arc;

a plurality of oppositely disposed first latch path pairs extending from said first chamber to each of said side edges;

a pair of first arms comprising said lateral edges of said male segment;

an outwardly disposed cam-type first latch defining a free end of said pair of first arms proximate said forward edge;

and wherein said male segment is slidably insertable into said female segment so as to maintain a plurality of locking positions, wherein said first latch maintains camming engagement with two opposing inside walls of said first chamber, and locking engagement with each of said first latch path pairs while said lateral edges abut said inside walls, wherein simultaneous finger pressure on outer edges of said first latch unlocks said male segment from said female segment so as to enable a person to alternate said locking positions and thus, to alternate the distance between said first wall and said second wall.

8. The device according to claim 1, further comprising:

a second chamber formed within said first wall and extending from said top edge to proximate said back arc;

a plurality of oppositely disposed second latch path pairs extending from said second chamber to each of said vertical edges;

a vertical, arcuate telescoping first wall extension having an upper first rim substantially normal to a pair of vertical second arms;

an outwardly disposed cam-type second latch defining a free end of said pair of said second arms; and wherein, said first wall extension is slidably insertable into said first wall so as to maintain a plurality of locking positions, wherein said second latch maintains camming engagement with two opposing inside walls of said second chamber, and locking engagement with each of said second latch path pairs, and wherein simultaneous finger pressure on outer edges of said second latch unlocks said first wall extension from said first wall so as to enable a person to alternate said locking positions, and therefore, to alternate the height of said base member.

9. The device according to claim 8, further comprising:

a third chamber formed within said second wall and extending from said upper edge to proximate said rear arc;

a plurality of oppositely disposed third latch path pairs extending from said third chamber to each of said upright edges;

a vertical, arcuate telescoping second wall extension having an upper second rim substantially normal to a pair of vertical third arms;

an outwardly disposed cam-type third latch defining a free end of said pair of said third arms; and wherein, said second wall extension is slidably insertable into said second wall so as to maintain a plurality of locking positions, wherein said third latch maintains camming engagement with two opposing inside walls of said third chamber, and locking engagement with each of said third latch path pairs, and wherein simultaneous finger pressure on outer edges of said third latch unlocks said second wall extension from said second wall so as to enable a person to alternate said locking positions and thus, to alternate the height of said base-supported member.

10. The device according to claim 9, wherein said second wall extends below said male segment, opposite said third chamber, by a distance equal to approximately one-half of the thickness of said female segment so as to form a leg for said male segment such that said male segment maintains horizontal alignment with said first chamber of said female segment.

11. The device according to claim 9, wherein said first rim and said second rim are capped with a rubbery material to facilitate capturing a top circumference of a plastic bag.

12. An extendible bag holding device comprising:

a book shelf shaped structure having a planar rectangular base plate with a front edge and a rear edge;

three parallel grooves shaped with a pentagonal cross-section are located in said base plate extending from the front edge and ending proximate the rear edge thereof;

said grooves separated by unequal distances; and two pairs of walls having different heights but identical widths and bottom configurations to snugly fit said grooves;

whereby a plastic bag of a certain size can be framed in the extendible bag holding device according to size by locating a selected pair of walls of equal height in said separated grooves.

13. An adjustable size bag holding device according to claim 12, wherein the planar rectangular base plate has a corrugated rubber layer positioned underneath.

14. An adjustable size bag holding device according to claim 12, wherein the two pairs of walls have pentagonal bottom portions.

* * * * *